US005918085A

United States Patent [19]

Rollins et al.

[11] Patent Number: 5,918,085

[45] Date of Patent: Jun. 29, 1999

[54] METHOD AND APPARATUS FOR WASTE TONER DETERMINATION

[75] Inventors: David E. Rollins, Lyons; Carmen J. Sofia, Rochester; Guru B. Raj, Fairport, all of N.Y.

[73] Assignee: Xerox Corporation, Stamford, Conn.

[21] Appl. No.: 08/837,038

[22] Filed: Apr. 11, 1997

[51] Int. Cl.[6] ..... G03G 15/08

[52] U.S. Cl. ..... 399/27; 399/35; 399/49

[58] Field of Search ..... 399/24, 27, 34, 399/35, 66, 28, 29, 50, 46, 49, 60, 74, 120, 264

[56] References Cited

U.S. PATENT DOCUMENTS

| | | | |
|---|---|---|---|
| 4,982,231 | 1/1991 | Matsuuchi | 399/35 |
| 5,237,373 | 8/1993 | Aimoto et al. | 399/35 |
| 5,260,755 | 11/1993 | Imaizumi | 399/35 |
| 5,296,903 | 3/1994 | Suzuki et al. | 399/66 |
| 5,365,312 | 11/1994 | Hillmann et al. | 399/12 |
| 5,500,716 | 3/1996 | Morishita et al. | 399/35 |
| 5,655,174 | 8/1997 | Hirst | 399/27 |

FOREIGN PATENT DOCUMENTS

| | | |
|---|---|---|
| 62-106477 | 5/1987 | Japan . |
| 62-223773 | 10/1987 | Japan . |
| 0229386 | 12/1990 | Japan . |
| 06324608 | 11/1994 | Japan . |
| 07104629 | 4/1995 | Japan . |
| 07168485 | 7/1995 | Japan . |
| 08129321 | 5/1996 | Japan . |

*Primary Examiner*—Arthur T. Grimley
*Assistant Examiner*—Hoan Tran

[57] ABSTRACT

A method and apparatus to track toner waste and the level of waste toner in a toner waste receptacle. A sensor measures the amount of toner developed on a photoreceptive member. At regular intervals a signal representing this developed toner amount is sent to a machine controller. The machine controller coverts the developed toner amount into an amount of residual waste based on the machine transfer efficiency. This residual waste amount is tracked and a signal is generated for a user as the toner waste receptacle approaches capacity. At full capacity an end of life signal is generated and for preservation of machine components the machine shuts down until the waste container is replaced.

8 Claims, 4 Drawing Sheets

METHOD AND APPARATUS FOR WASTE TONER DETERMINATION

This invention relates generally to a customer replaceable unit (CRU) for a printing machine, and more particularly concerns a photoreceptor module for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a CRU is a customer replaceable unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

One of the functions performed by the CRU is the storage of waste toner that is cleaned from the photoreceptive member by the cleaning system. many systems use replaceable waste toner containers or other removable containers.

Electrophotographic printing machines have managed residual toner to the waste bottle in a number of ways. Tracking of residual toner is critical due to the fact that waste overflow of the bottle can cause failures of the xerographic process. Failures result in contamination and copy quality issues with the copier and on output copies.

Residual toner to the waste bottle/sump has been managed through the use of optical sensor and pressure sensors or scales. These techniques trip a fault code or message when the residual toner has reached a certain level in the waste bottle or a specified weight of toner. although widely used both techniques are plagued with false trips of the sensor.

Other waste management techniques involve stopping the unit at a copy interval which insures the volume will not overflow the waste sump. In doing so, maximum capacity usage of the sump may not be realized.

It is desirable to have an apparatus and method to determine the amount of waste toner that is generated and stored in the waste toner container without relying on failure prone sensors or other inaccurate detection schemes.

The following disclosures may relate to various aspects of the present invention.

U.S. Pat. No. 5,592,298 Patentee: Caruso Issue Date: Jan. 7, 1997

U.S. Pat. No. 5,585,899 Patentee: Palumbo et al. Issue Date: Dec. 17, 1996

U.S. Pat. No. 5,463,455 Patentee: Pozniakas Issue Date: Oct. 31, 1995, 1995

U.S. Pat. No. 5,459,556 Patentee: Acquaviva et al. Issue Date: Oct. 17, 1995

Some portions of the foregoing disclosures may be briefly summarized as follows:

U.S. Pat. No. 5,592,298 discloses a system for estimating pixel coverage in a digitized image including a controller for sampling pixels in a byte stream according to a varying spaced sampling mode so as to avoid image pattern errors. A processor for sums the sampled pixels, so that a total pixel on count in the digitized image may be estimated. A plurality of pixels may be included in bytes in the data stream; a look-up table, random number generator or other device may be used to select the addresses of the bytes to be sampled in the byte stream. The system may include an ink metering controller for providing ink to a printer or a printer service status indicator for providing various forms of printer consumable and component service data.

U.S. Pat. No. 5,585,899 discloses an apparatus for replenishing toner in a developer unit has a plurality of toner discharge units. A selected discharge unit is energized to dispense toner into the developer unit with the other discharge units being de-energized. After the energized discharge unit is substantially depleted of toner, another toner discharge unit is energized. The depleted toner discharge unit is removed and replaced with a new toner discharge unit.

U.S. Pat. No. 5,463,455 discloses an adaptive cleaner blade lubricating system for electrophotographic printing machines. In an electrophotographic printing machine, the amount of residual toner available to lubricate a cleaner blade is calculated based on the density of the transferred image. A band of toner is deposited in an inner document gap in selective widths so as to provide an adequate amount of toner to lubricate the cleaner blade across the full width of the photoreceptor. The lubricating band may be variable or may be a constant width with the frequency of placement of the band determined based on average image density for a group of documents. In the preferred embodiment, the width of the toner band is varied as a function of the overall residual toner in each pixel location across the width of the photoreceptor based on the density of the images transferred. As a result of the varying lubrication bands, the cleaner blade is maintained so as to not tuck and cause streaking and/or damage while toner efficiency is maximized.

U.S. Pat. No. 5,459,556 discloses a toner meter for determining a rate of toner usage per print in a printing machine of the type having operator actuatable settings effecting the rate of toner usage per print. The meter has a controller for calculating the rate of toner usage per print responsive to actuation of an operator actuatable setting and a indicator in communication with the controller, for indicating the calculated rate of toner usage.

In accordance with one aspect of the present invention, there is provided an apparatus to determine the level of waste toner in a receptacle, comprising a sensor to measure the amount of developed toner on a photoreceptive member and to generate a signal indicative thereof, a controller to receive the signal generated by said sensor and to calculate the residual toner on the photoreceptive member as a function thereof and a counter, to total the amount of residual toner and to generate a plurality of signals with respect thereto.

Pursuant to another aspect of the present invention, there is provided an electrophotographic printing machine having a device to determine the level of waste toner in a receptacle, comprising a sensor to measure the amount of developed toner on a photoreceptive member and to generate a signal indicative thereof a controller to receive the signal generated by said sensor and to calculate the residual toner on the photoreceptive member as a function thereof and a counter, to total the amount of residual toner and to generate a plurality of signals with respect thereto.

Pursuant to yet another aspect of the present invention, there is provided a method of determining an amount of residual toner in a printing machine comprising measuring the amount of toner developed on a photoreceptive member, signaling an amount representing this developed toner to a machine controller, converting the developed toner amount into an amount of residual waste based on the machine transfer efficiency and tracking the residual waste amount and generating a signal as the toner waste receptacle approaches capacity.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
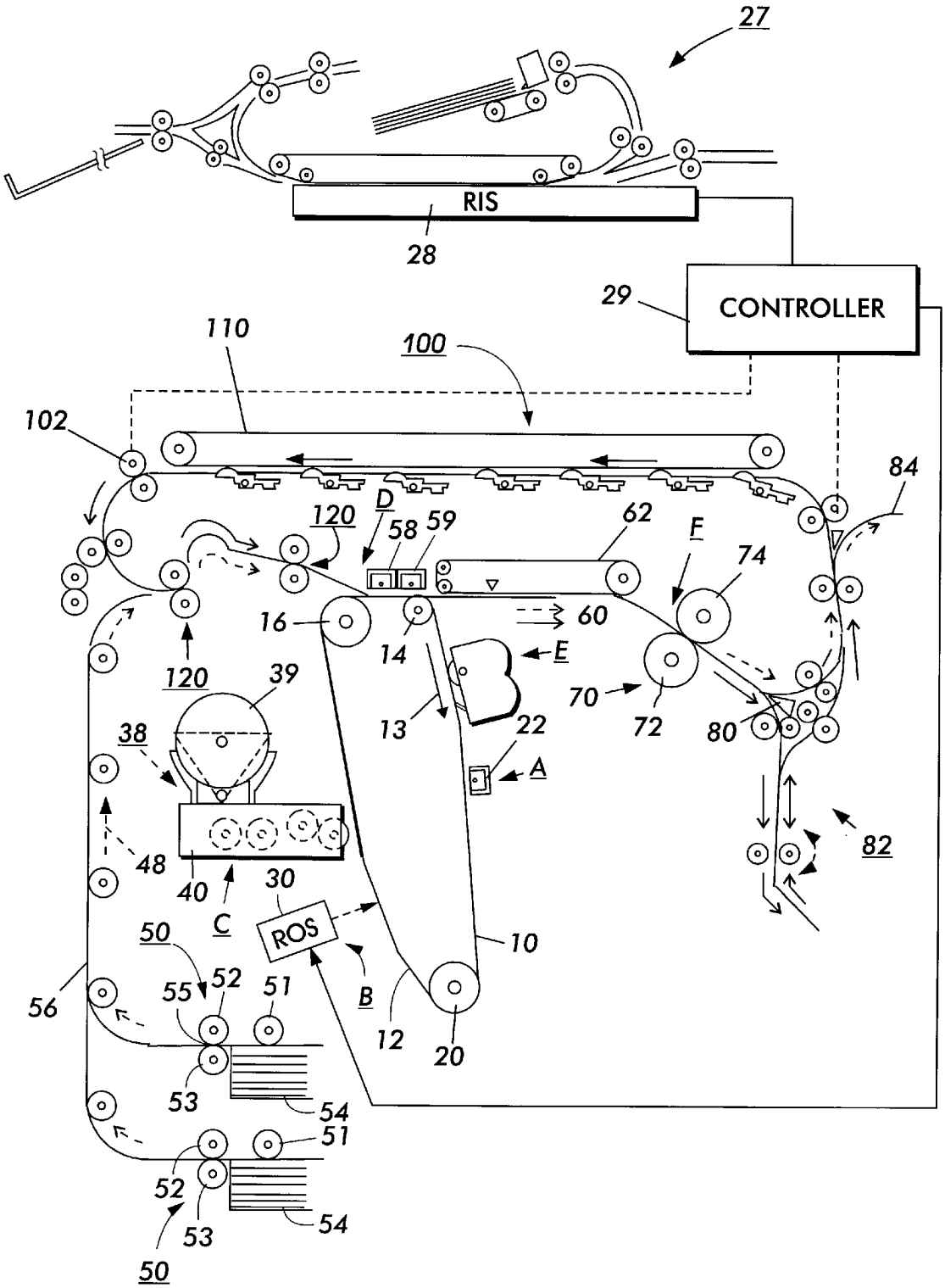
FIG. 1 is a schematic elevational view of a typical electrophotographic printing machine utilizing the method and apparatus for waste toner determination of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the method and apparatus for waste toner determination of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
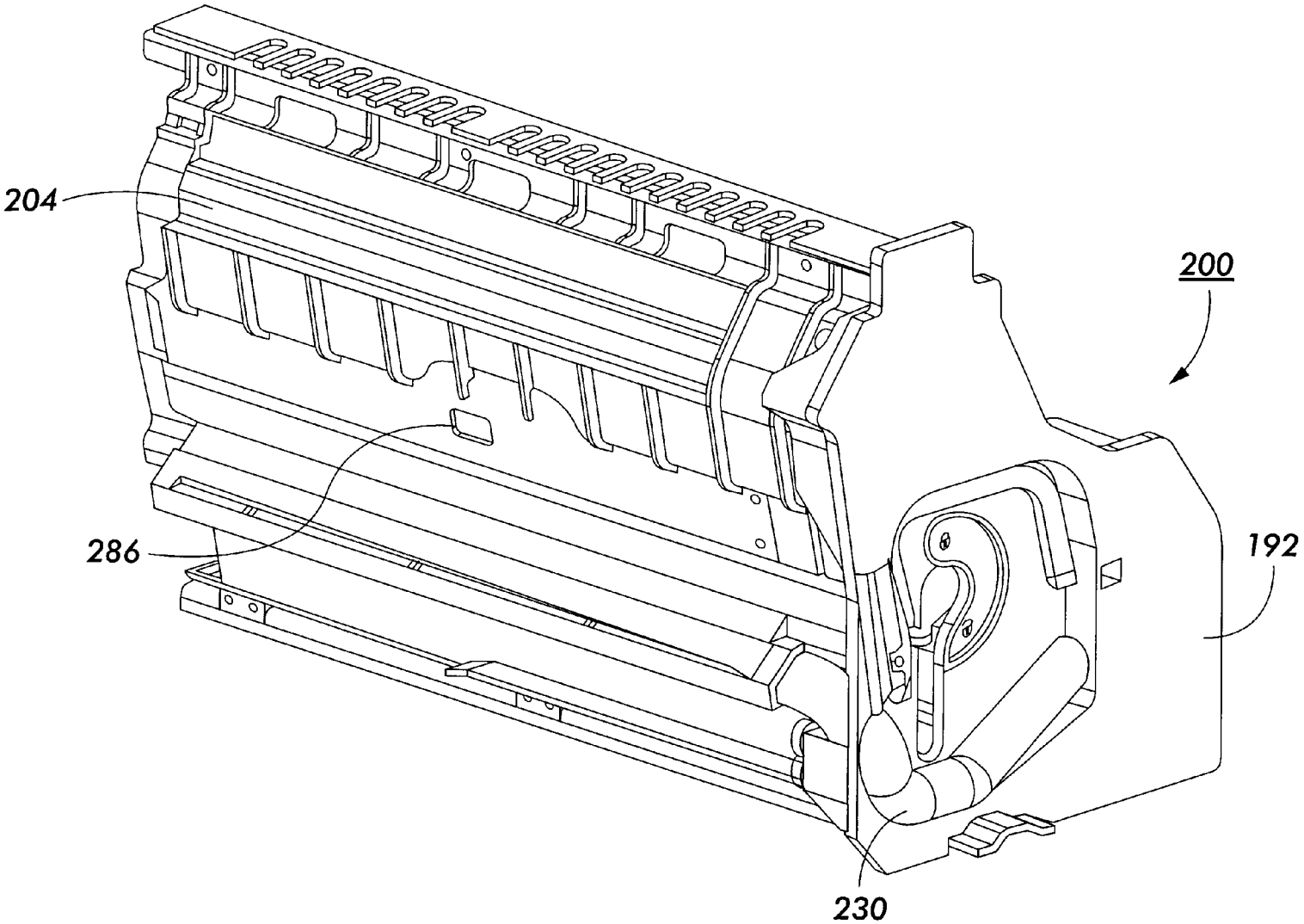
FIG. 2 is a perspective view of one side of a xerographic CRU.
Figure 3:
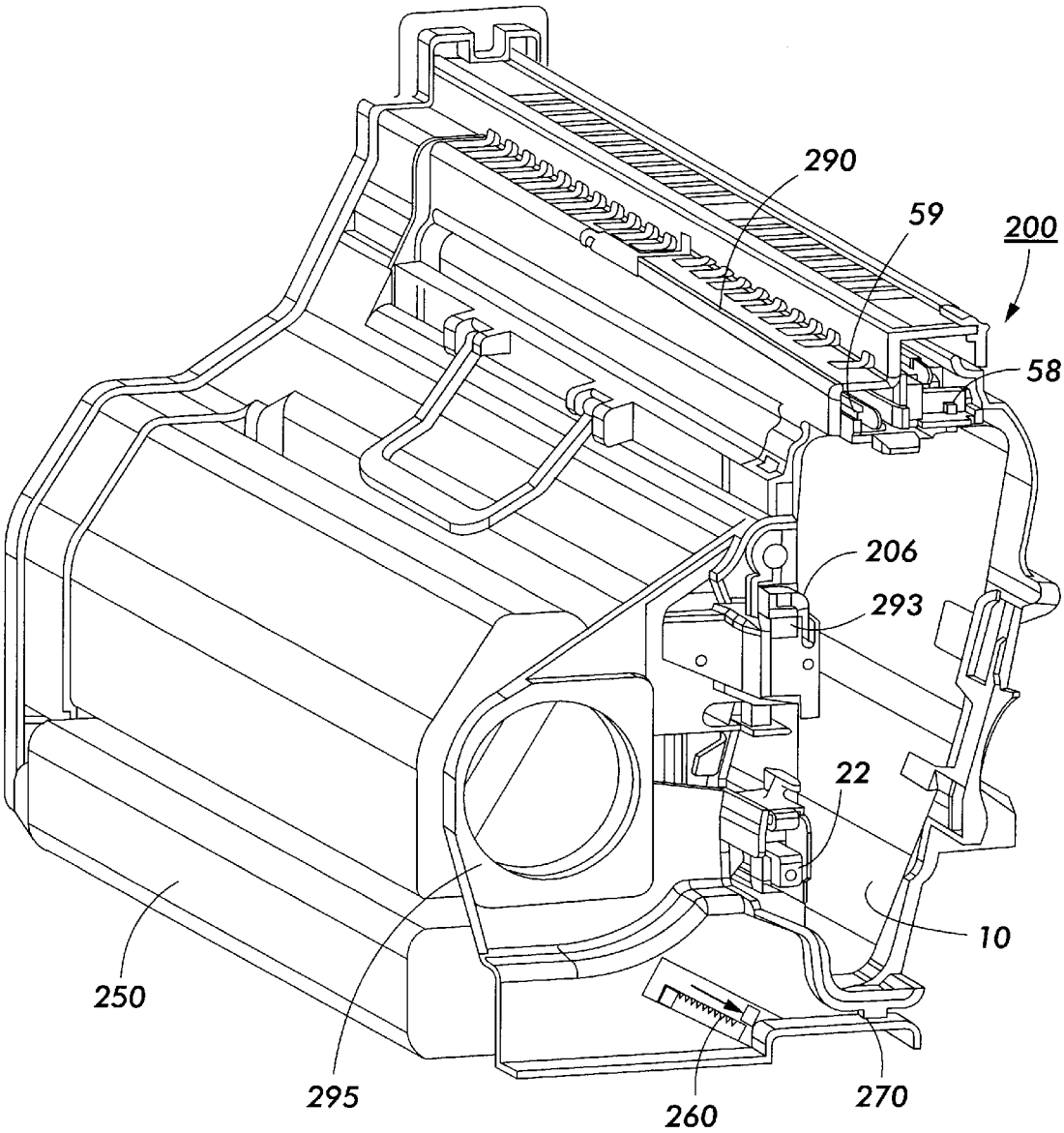
FIG. 3 is a perspective view of the opposite side of the FIG. 2 CRU.
Figure 4:
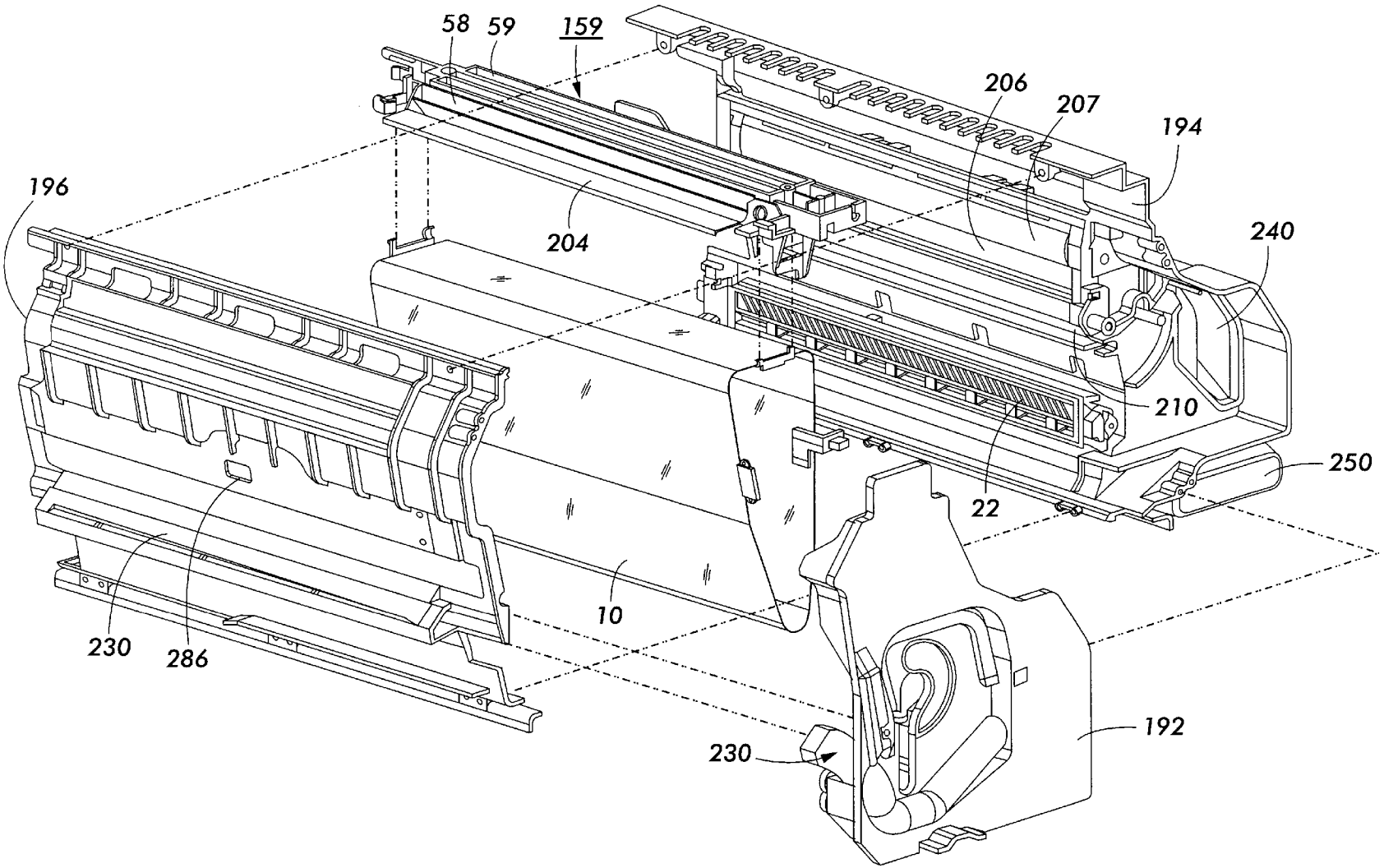
FIG. 4 is an exploded perspective view of the xerographic CRU module further illustrating the components thereof.

Turning next to FIGS. 2 through 4, there is illustrated perspective views of the xerographic customer replaceable unit (CRU) 200. The xerographic CRU 200 module mounts and locates xerographic subsystems in relationship to the photoreceptor module 300 and xerographic subsystem interfaces. Components contained within the xerographic CRU include the transfer/detack corona generating devices 58, 59, the pretransfer paper baffles 204, the photoreceptor cleaner 206, the charge scorotron 22, the erase lamp 210, the photoreceptor(P/R) belt 10, the noise, ozone, heat and dirt (NOHAD) handling manifolds 230 and filter 240, the waste bottle 250, the drawer connector 260, CRUM 270, the automatic cleaner blade engagement/retraction and automatic waste door open/close device (not illustrated).

A summary of the xerographic CRU components and the function of each is as follows:

Cleaner (Doctor blade 206 and Disturber Brush 207): remove untransferred toner from the photoreceptor; transport waste toner and other debris to a waste bottle 250 for storage; assist in controlling the buildup of paper talc, filming and comets on the photoreceptor belt.

Precharge Erase Lamp 210: provides front irradiation of the photoreceptor to the erase the electrostatic field on the surface Charge Pin Scorotron 22: provides a uniform charge level to the photoreceptor belt in preparation for imaging.

Photoreceptor Belt 10: charge retentive surface advances the latent image portions of the belt sequentially through various xerographic processing stations which converts electrostatic field on the surface Pretransfer Paper Baffles 204: directs and controls tangency point between the paper and photoreceptor surface. Creates an "S" bend in paper to flatten sheet in the transfer zone.

Transfer Wire Corotron 58: places a charge on the paper as in passes under the corotron. The high positive charge on the paper causes the negative charged toner to transfer from the photoreceptor to the paper.

Detack Pin Corotron 59: assist in removing paper with its image from the photoreceptor by neutralizing electrostatic fields which may hold a sheet of paper to photoreceptor 10. Sheet self strips as it passes over a stripper roll 14 on belt module 300.

NOHAD Dirt Manifolds 230 and Filter 240: removes airborne toner dirt and contaminates from the moving air before it leaves the CRU. The captured toner and contaminates are deposited in a dirt filter contained in the xerographic CRU.

Electrical Drawer Connector 260: provides connector interface for the CRUM; provides input/output for machine control.

CRUM Chip 270: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point; enables market differentiation; enables CRU life cycle planning for remanufacture; enables remote diagnostics; provides safety interlock for the ROS.

ROS and Developer Interface: provides a developer interface window to allow transfer of toner for imaging from developer donor roll 47 to P/R belt surface 12 latent image; Also, provides critical parameter mounting and location link which ties ROS 30 to P/R module 300 to ensure proper imaging and eliminate motion quality issues.

BTAC Sensor Interface 286: provides interface window to monitor process controls.

Registration Transport Interface 288: provides outboard critical parameter location and mounting feature.

Prefuser Transport Interface 290: provides critical parameter location and mounting feature.

The CRU subsystems are contained within the xerographic housing 190. The housing consist of three main components which include the front end cap 192, right side housing 194 and left side housing 196. The xerographic housing 190 is a mechanical and electrical link. It establishes critical parameters by mounting and locating subsystems internal and external to the CRU in relationship to the photoreceptor module 300 and other xerographic subsystem interfaces. The housing allows easy reliable install and removal of the xerographic system with out damage or difficulty In the technique used to track waste toner herein, the BTAC sensor (not shown) is utilized to count the number of pixels generated every time an image is developed on the P/R belt 10. These may be pixels due to setup, interdocument and cleaning patches and all other images. In turn, the number of pixels to residual waste is determined through a machine algorithm which accounts for the transfer efficiency of the machine. These pixel usage values are stored in the machine memory. At machine cycle out or specified time intervals, these values are downloaded to the CRUM 270.

Contained within the CRU 200 is the CRUM chip 270. The CRUM chip 270 has two counters within the CRU Print Counter and Pixel Usage Counter. The pixel usage counter is decremented each time the machine data is downloaded to the CRUM chip. The pixel usage value starts a maximum value is decremented until the value reaches zero. Once the value reaches zero for the pixel usage a message is displayed indicating CRU end of life.

The maximum pixel usage value is determined based on the maximum toner capacity of the waste bottle 250. The maximum value insures the bottle volume will accommodate any distribution tails of fill capacity.

During the process of pixel usage value countdown, the CRUM 270 will trigger three messages as the unit approaches end of life on the user interface. Those messages are: "Reorder Xerographic CRU", "Get Ready to Replace Xerographic CRU" and "Replaces" or "End of Life Notification". The first two messages prepare customer for an impending CRU end of life.

Pixel usage counting is a more reliable method of managing residual waste toner. It allows for fewer parts and reduced cost and manages waste toner to bottle based on developed toner on the P/R belt.

While the invention herein has been described in the context of a black and white printing machine, it will be readily apparent that the device can be utilized in electrophotographic printing machine tracking of toner usage and maximizing of toner waste capacity is desired.

In recapitulation, there is provided a method and apparatus to track toner waste and the level of waste toner in a toner waste receptacle. A sensor measures the amount of toner developed on a photoreceptive member. At regular intervals a signal representing this developed toner amount is sent to a machine controller. The machine controller coverts the developed toner amount into an amount of residual waste based on the machine transfer efficiency. This residual waste amount is tracked and a signal is generated for a user as the toner waste receptacle approaches capacity. At full capacity an end of life signal is generated and for preservation of machine components the machine shuts down until the waste container is replaced.

It is, therefore, apparent that there has been provided in accordance with the present invention, a method and apparatus to track toner waste that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus to determine the level of waste toner in a receptacle, comprising:

a sensor to measure the amount of developed toner on a photoreceptive member and to generate a signal indicative thereof;

a controller to receive the signal generated by said sensor and to calculate the residual toner on the photoreceptive member as a function thereof;

a counter, to total the amount of residual toner and to generate a plurality of signals with respect thereto.

2. An apparatus according to claim 1, wherein said plurality of signals generated by said counter include "Reorder Xerographic CRU", "Get Ready to Replace Xerographic CRU" and "Replace" or "End of Life Notification".

3. An apparatus according to claim 2 wherein upon generating the "Replace" or "End of Life Notification" signals a machine is shut down by said controller.

4. An electrophotographic printing machine having a device to determine the level of waste toner in a receptacle, comprising:

a sensor to measure the amount of developed toner on a photoreceptive member and to generate a signal indicative thereof;

a controller to receive the signal generated by said sensor and to calculate the residual toner on the photoreceptive member as a function thereof;

a counter, to total the amount of residual toner and to generate a plurality of signals with respect thereto.

5. A printing machine according to claim 4, wherein said plurality of signals generated by said counter include "Reorder Xerographic CRU", "Get Ready to Replace Xerographic CRU" and "Replace" or "End of Life Notification".

6. A printing machine according to claim 5 wherein upon generating the "Replace" or "End of Life Notification" signals the machine is shut down by said controller.

7. A method of determining an amount of residual toner in a printing machine comprising:

measuring the amount of toner developed on a photoreceptive member;

signaling an amount representing this developed toner to a machine controller;

converting the developed toner amount into an amount of residual waste based on the machine transfer efficiency; and tracking the residual waste amount and generating a signal as the toner waste receptacle approaches capacity.

8. A method according to claim 7, wherein at full capacity an end of life signal is generated and for preservation of machine components the machine shuts down until the waste container is replaced.

* * * * *